United States Patent [19]

Joyce

[11] Patent Number: 4,726,091

[45] Date of Patent: Feb. 23, 1988

[54] TWO PART SNAP HINGE

[76] Inventor: Michael Joyce, 287 Smoke Rise Rd., Kinnelon, N.J. 07405

[21] Appl. No.: 904,868

[22] Filed: Sep. 8, 1986

Related U.S. Application Data

[63] Continuation of Ser. No. 698,160, Feb. 4, 1985, abandoned, which is a continuation-in-part of Ser. No. 568,623, Jan. 6, 1984, Pat. No. 4,503,991.

[51] Int. Cl.[4] ..... E05D 1/00

[52] U.S. Cl. ..... 16/227; 16/225; 16/DIG. 13; 220/339; 220/335

[58] Field of Search ..... 16/225, 227, DIG. 13; 220/335, 337, 339; 215/216, 224, 235, 237; 222/517, 498; 229/44 R

[56] References Cited

U.S. PATENT DOCUMENTS

| | | | |
|---|---|---|---|
| Re. 30,861 | 2/1982 | Krawagna | 16/293 |
| 2,654,118 | 10/1953 | Scott | 16/293 |
| 2,905,356 | 9/1959 | Jerome | 220/323 |
| 3,618,161 | 11/1971 | Nozawa | 16/227 |
| 3,628,215 | 12/1971 | Everburg | 16/150 |
| 4,095,712 | 6/1978 | Perrella | 220/339 |
| 4,346,810 | 8/1982 | Kneissl | 215/237 |
| 4,377,247 | 3/1983 | Hazard et al. | 220/335 |
| 4,403,712 | 9/1983 | Wiesinger | 220/335 |
| 4,457,458 | 7/1984 | Heinol | 215/235 |
| 4,503,991 | 3/1985 | Joyce | 16/227 |

FOREIGN PATENT DOCUMENTS

| | | | |
|---|---|---|---|
| 695905 | 10/1964 | Canada . | |
| 1096282 | 12/1960 | Fed. Rep. of Germany . | |
| 3212725 | 10/1983 | Fed. Rep. of Germany . | |
| 5231269 | 9/1977 | Japan | 16/225 |
| 1056999 | 1/1967 | United Kingdom . | |

*Primary Examiner*—Paul A. Bell
*Assistant Examiner*—James L. Wolfe
*Attorney, Agent, or Firm*—Lerner, David, Littenberg, Krumholz & Mentlik

[57] ABSTRACT

An improved two part snap hinge is disclosed, including a swinging hinge portion, a reference hinge portion, and a reduced connecting hinge portion, and in which the reduced connecting portion is integral with both the swinging and reference hinge portions and extends continuously between two points in a path which is displaced from the straight line therebetween, and which lies in a plane substantially perpendicular to the plane of the reference hinge portion. In this manner, upon swinging the swinging portion about the reduced connecting portion, it swings through an intermediate position, on either side of which forces are created which tend to urge the swingable portion in a predetermined direction.

22 Claims, 43 Drawing Figures

TWO PART SNAP HINGE

CROSS REFERENCES TO RELATED APPLICATIONS

This is a continuation of application Ser. No. 698,160 filed Feb. 4, 1985, now abandoned, which is a continuation-in-part of application Ser. No. 568,623, filed on Jan. 6, 1984, now U.S. Pat. No. 4,503,991.

FIELD OF THE INVENTION

This invention relates to an improved biasing or snap hinge preferably made of two thermoplastic parts connected together by an integral reduced portion.

BACKGROUND OF THE INVENTION

One of the most significant design innovations made possible by the introduction of plastic materials was the concept of the integral hinge, sometime referred to as the living hinge or film hinge. The integral hinge has been molded into a wide variety of products ranging from small bottle caps and jewelry boxes to large complex closures and housings. Hinges with one part biased toward either of two positions are also well known in the art. However, all of these biased hinges require a spring to achieve the snap or biasing action in addition to the two hinge members themselves.

The oil can principle is common in mechanic's oil cans wherein the oil can bottom is domed or bowed outward at its center. To dispense oil, the mechanic presses the bow with his thumb forcing it through a flat configuration to a reverse bowed position and thus reducing the volume of the oil can forcing the oil out. When the thumb pressure is released, the pressure is released, the internal forces stored in the distorted can bottom spring it back to its arched position.

Examples of snap action hinges typical of this prior art include U.S. Pat. No. 4,414,705, which includes the typically required third spring member in order to introduce the snap or biasing action into the hinge, and U.S. Pat. No. 3,289,877.

Other such hinges are shown in U.S. Pat. No. 3,545,034, which again shows a two part hinge, in this case connected by a hinge pin in the form of a bowed spring wire; in U.S. Pat. No. 3,760,972, which shows a container cover which is operable in response to pressure thereon; and in U.S. Pat. No. 4,095,712, which shows a container lid with a closable flap, and in which the lid is elastically deformable and is opened and closed in response to pressure on the minor part of the lid.

SUMMARY OF THE INVENTION

In accordance with the present invention it has now been discovered that such a snap hinge can be provided which indirectly incorporates this oil can principle, and which includes a swingable portion, a reference portion, and a reduced connected portion therebetween, with the reduced connecting portion being integral with both the swingable and reference portions, and extending continuously between a first point and a second point so that the reduced connecting portion follows a path which is displaced from a straight line connecting the first and second points, and which lies in a plane which is substantially perpendicular to the plane of the reference portion of the hinge, so that upon swinging the swingable portion about the reduced connecting portion, it swings through an intermediate position, such that on either side of the intermediate position forces are created in the swingable portion which tend to urge it in a predetermined direction.

In accordance with one embodiment of the hinge of the present invention, a reference portion includes a first end corresponding to the reduced connection portion and a second end displaced from the reduced connecting portion, and the surface of the reference portion between the first and second ends comprises a plurality of paths having a degree of curvature which is substantially continuously reduced as compared to that of the path of the reduced connecting portion.

In accordance with a preferred embodiment of the hinge of the present invention, on one side of the intermediate position the swingable portion is urged into a first bowed configuration and on the other side of the intermediate position the swingable portion is urged into a second bowed configuration, the first and second bowed configurations being configurations which are bowed on opposite sides of the plane of the swingable portion.

In accordance with a preferred embodiment of the hinge of the present invention, the hinge is prepared from molded plastic. Preferably, the swingable portion is a closable portion for a container and the reference portion is at least a portion of one wall of that container. In a preferred embodiment, the hinge comprises a thermoplastic or thermosetting material.

In accordance with another embodiment of the hinge of the present invention, the path which the reduced connecting portion follows comprises a plurality of substantially linear path portions.

In accordance with another embodiment of the hinge of the present invention, the swingable portion comprises only a portion of a container lid, and the hinge also includes a reduced connecting portion integral with the swingable portion and the remaining portion of the lid. In a preferred embodiment, the swingable portion is thinner than the remaining portion of the lid. Also, the reduced connecting portion can be substantially arcuate and/or it can be substantially parabolic in shape.

In accordance with another embodiment of the hinge of the present invention, the reference portion is a portion of a closure wall, preferably one which is substantially cylidrical, and the reference portion comprises a substantially planar chord portion of the substantially cylindrical wall. Preferably, the swingable portion comprises a portion of a closure lid.

BRIEF DESCRIPTION OF THE DRAWINGS

Referring next to the drawings, which are referred to in the following detailed description of the invention, which can more fully describe the subject matter of the present invention, in which.

DETAILED DESCRIPTION

Figure 1:
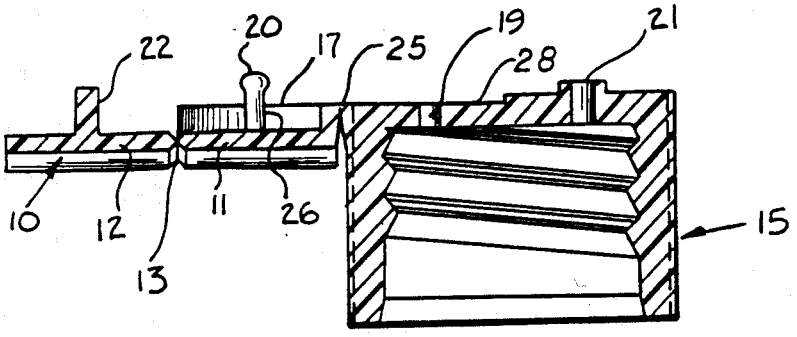
FIG. 1 is a side, cross-sectional view of a hinge according to the invention used in combination with a two piece closure.

Now with more particular reference to the various embodiments of the invention, several examples of the application and function of the two part snap hinge according to this invention will be discussed.

In reviewing these embodiments, however, it should be realized that in each case the applicant has created a novel snap hinge by providing a deformation in one of the hinge members so as to change its shape in a manner such that, in use of the hinge, energy can be transferred to the other hinge member, and these hinge members are thus biased by that released energy in the direction of one of two stable positions on either side of a central, unstable position. In this manner, the internal stresses set up in the hinge itself function in the manner of a spring, biasing the hinge members to one or the other of these two stable positions. The hinges of the present invention can be made from any resilient thermoplastic material such as polypropylene, polyethylene, polystyrene or similar polymers, while on the other hand it can also be made of flexible thermosetting materials such as urethanes or flexible thermosetting elastomers such as rubber.

Referring to the Figures, in which like numerals refer to like portions thereof, in FIGS. 1 through 6, a closure 15 is shown having a cylindrical side wall and a top 28 with a flat top surface. This type of closure could, for example, be internally threaded to be applied to the threaded neck of a bottle. The top has a dispensing opening 21 and a pintle receiving opening 19.

The lid 10 of the closure 15 has a pintle 26 integrally formed thereon, with a head 20. The lid 10 is hinged to the closure at hinge 25, and the lid 10 itself includes a hinge 13 integrally created between two hinge elements 11 and 12, which in this case also constitutes the entire lid 10. When the first hinge portion 11 is swung to the closed position shown in FIGS. 3, 5 and 6, the pintle 26 enters the opening 19 and the head 20 is forced through the opening, and being made of a resilient material the head returns to its original size after passing through the opening 19 to hold the pintle 26, preventing the pintle from withdrawal. The pintle 26 is sufficiently short that when it is pushed through the opening 19 to move the head 20 below the bottom of the top 28, the lid member and hinge portion 11 is bowed downward to conform generally to a portion of a cylinder, as is shown in FIG. 6. The hinge member 11 has a peripheral flange 17 which rests on the top 28 of the closure 15 when the first hinge portion is swung into the position shown in FIGS. 3, 5 and 6. The head 20 will underlie the top 28 and hold the first hinge member 11 in this bowed or distorted configuration, bowed about a radius that is perpendicular to the top surface of the hinge portion 11. The first hinge member 11 is swingably attached to the closure 15 by integral hinge 25, while the second hinge portion 12 is hinged to the first hinge portion 11 by the integral reduced connecting position 13. The edge of the second hinge portion 12 attached to reduced connecting portion 13 will be bowed or distorted due to the force exerted on it by a force transferred to the first hinge portion 11 when it is in the bowed configuration shown in FIG. 6. The forces exerted on the second hinge portion 12 by first hinge portion 11 in this configuration will distort and bias it toward the position shown in FIG. 3. Should the hinge portion 12 then be moved manually further from the position shown in FIG. 3, the distortion then created in the first hinge portion 11 will tend to be straightened as the second hinge portion 12 is moved toward the position shown in FIGS. 4 through 6. In the position shown in FIGS. 4 through 6 the second hinge portion 12 will be disposed generally at right angles to the first hinge portion 11, and the beam action of the hinge portion 12 will tend to straighten the hinge portion 11, and at the same time warp hinge portion 12, thereby exerting a balanced force which will not tend to bias the hinge portion 12. It should also be understood that while in this embodiment the intermediate, unstable condition is created when the two hinge portions are disposed generally at right angles with respect to each other, this does not necessarily have to be the case in all situations. Different angles could thus exist at which this intermediate, unstable condition is created. In any event, in this particular case, the stresses on the hinge portion 12 will distort it or warp it somewhat into the shape of the configuration shown in FIG. 4 when viewed from above. This is what has been referred to as its unstable or intermediate configuration. When the hinge portion 12 is then swung further toward the open position, i.e. with the second hinge portion 12 in contact with the first hinge portion 11, the biasing force tending to straighten the warped shape of the hinge portion 12 will exert a biasing force which will tend to swing the hinge portion 12 into that open position.

Figure 3:
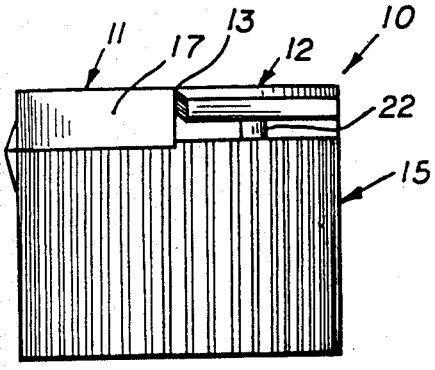
FIG. 3 is a side view of the closure shown in FIG. 1, with the lid closed.
Figure 4:
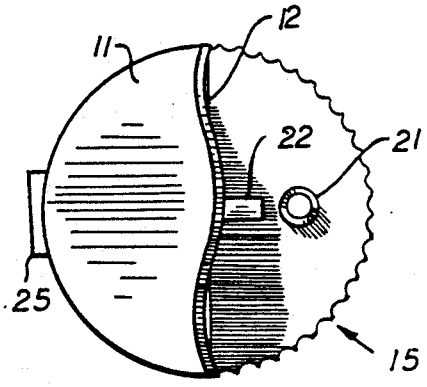
FIG. 4 is a top view of the closure of FIG. 1, with the lid partially open.
Figure 5:
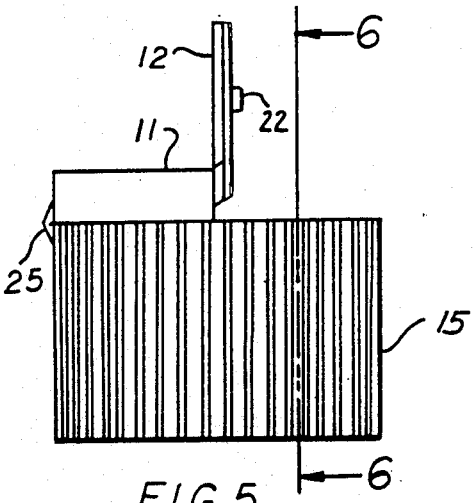
FIG. 5 is a side view of the closure shown in FIG. 4.
Figure 6:
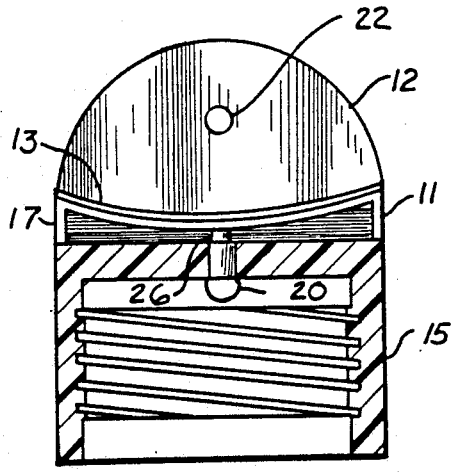
FIG. 6 is a front, cross-sectional view of the closure of FIG. 5, taken on line 6—6 thereof.
Figure 7:
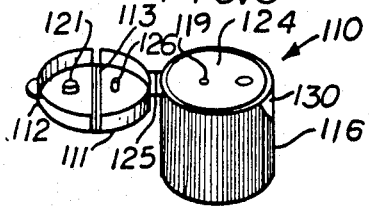
FIG. 7 is an isometric view of another embodiment of the hinge of the present invention in combination with a closure.
Figure 8:
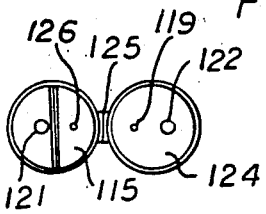
FIG. 8 is a top view of the hinge and closure shown in FIG. 7.

Therefore, the second hinge portion or lid member 12 will be biased toward the closed position shown in FIG. 3 when it is moved beyond the position shown in FIG. 4 or 5 toward the closed position, in which the pin 22 blocks the dispensing opening 21. On the other hand, the second hinge portion or lid portion 12 will be biased toward a partially open position when it is moved to the left in the configuration shown in FIGS. 4 and 5, to an open position in which the two hinge portions 11 and 12 are in parallel abutment with each other. In this manner it can be seen that the overall hinge made up of hinge portions 11 and 12 and reduced connecting portion 13, when operated in this manner, can be described as including a reference portion 11 which remains stationary and a swingable portion 12 which swings between closed and open positions through an intermediate, unstable position therebetween.

When it is thus desired to dispense material through the opening 21, lid member 12 will be swung beyond the position shown in FIG. 5, and it will be biased toward the fully open position 180° from the position shown in FIG. 3 by the internal forces stored in the resilient material making up the hinge portions 11 and 12, and in the position 180° from the position shown in FIG. 3, the hinge portion 11 will have a reverse curvature to the curvature it has when in the position shown in FIG. 6.

Figure 2:
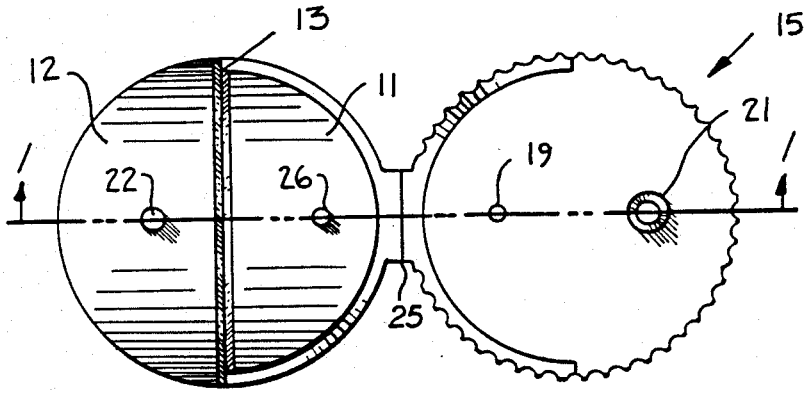
FIG. 2 is a top view of the hinge and closure as shown in FIG. 1.

This closure can be molded in a two piece mold in the position shown in FIGS. 1 and 2. The necessary bow to create the bias in the hinge will then be formed when lid member 11 is closed to the position shown in FIGS. 3, 5 and 6. In that position pintle 26 will hold lid member 11 in the shape of a portion of a cylinder.

Figure 9:
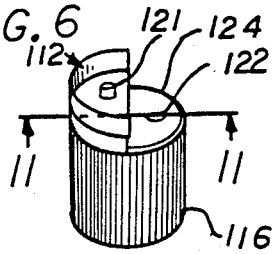
FIG. 9 is an isometric view of the closure shown in FIG. 6, with the second hinge portion in an open position.
Figure 10:
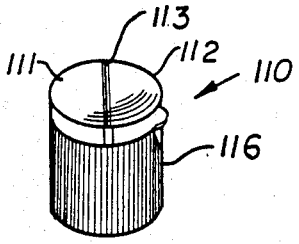
FIG. 10 is an isometric view of the closure shown in FIG. 6, with both lid members closed.
Figure 11:
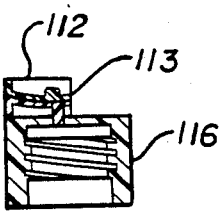
FIG. 11 is a side, cross-sectional view of the closure of FIG. 9, taken on line 11—11 thereof.

Reference is next made to the embodiment of the invention shown in FIGS. 7 through 11. In this case a hinge according to this invention is applied to a lid 110 of a closure 116. Closure 116 has a generally flat top 124 with a dispensing opening 122 and a pintle receiving opening 119 in it. The closure 116 may also be internally threaded. The first lid portion 111 is swingably connected to the closure 116 by means of an integral hinge 125. The lid 110 is itself made up of a first portion 111 and a second portion 112. Each of these lid portions 111 and 112 has a peripheral downwardly extending flange, and the lid members are concave, as best shown in FIG. 10. When the first portion 111 is swung into the position shown in FIG. 10, the pintle 26 is received in the hole 119, and it will hold the first lid portion 111 in the position shown in FIGS. 9–11. When portion 112 is in the position shown in FIGS. 9 and 11, a stress will be introduced between the lid portions 111 and 112, due to the distortion of lid portion 111, thus biasing the lid portion 112 toward the open position shown in FIGS. 9 and 11. Pintle 126 will thus bias the lid portion 111, which would, in turn, create a curvature in member 112, and therefore the bias function will be like that of the hinge of FIGS. 1 through 6.

If the lid portion 112 is swung from the position shown in FIG. 9 toward the position shown in FIG. 10, when it passes the intermediate or vertical position it will be distorted by the lid portion 111, which will then bias the lid portion 112 toward the closed position shown in FIG. 10.

A suitable latch 130 can also be provided for the lid portion 111, of a type familiar to those skilled in the art, to hold it in the fully closed position shown in FIG. 10. Furthermore, the closure shown in FIGS. 7 and 8 can be molded in one piece, in the position shown therein, in a two piece mold. The lid can thus have a concave top with a curved hinge line or reduced connecting portion 113 as shown.

Figure 12:
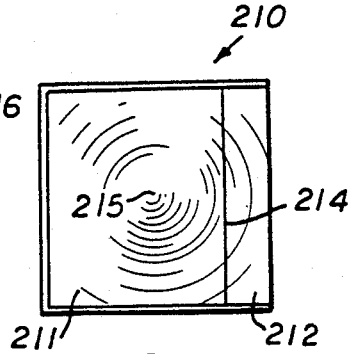
FIG. 12 is a top view of another embodiment of the hinge of the present invention, in combination with a container.
Figure 13:
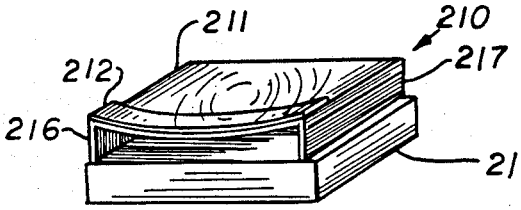
FIG. 13 is a front, isometric view of the hinge and container shown in FIG. 12.
Figure 14:
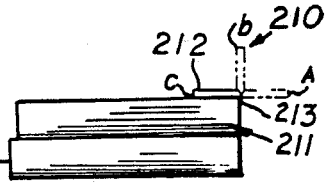
FIG. 14 is a side view of the hinge and container shown in FIG. 12.
Figure 15:
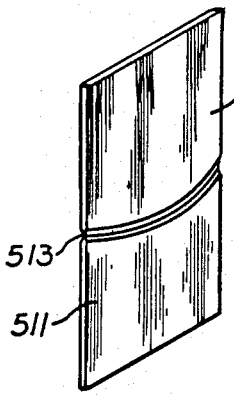
FIG. 15 is a side, isometric view of another embodiment of the hinge of the present invention.
Figure 16:
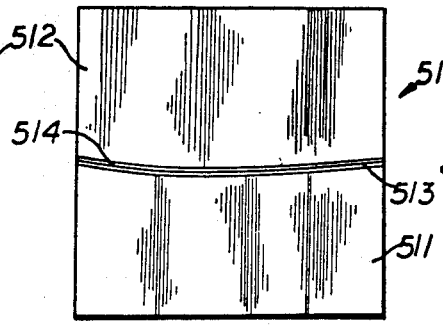
FIG. 16 is a front, isometric view of the hinge shown in FIG. 15.

Reference is next made to the embodiment of the invention shown in FIGS. 12, 13 and 14. In this embodiment the hinge 210 includes a first or reference hinge portion 211, a second or swingable hinge portion 212, and an integral reduced connecting portion 213, whereby the swingable portion 212 can swing from position A through the intermediate position B, to position C, as shown in FIG. 14. In this embodiment the distortion in the reduced connecting portion and in the reference portion 211 is not created by the use of the pintle type arrangement discussed above, but in a more preferred embodiment is actually created by molding these portions in that distorted configuration. The plate-like hinge members are thus molded in the distorted configuration which is shown in FIG. 13 as being a concave surface in the form of a part of a sphere having a radius perpendicular to hinge member 211, which in turn causes the reduced connecting portion 213 to follow the curved path shown therein. The operation of hinge portions 212 and 211 is now similar to operation of the corresponding parts in FIGS. 1 through 6. When hinge portion 212 is in the molding position of FIG. 12, there will be no added stress in the hinge portion, i.e the curvature of hinge portion 212 follows or corresponds to that of hinge portion 211. When portion 212 is then swung into position (C) shown in full lines in FIG. 14, the hinge portion 212 will be forced into the form of a curve reversed to that shown in FIG. 12. Thus, the stresses introduced in the two hinge portions during this swinging movment will be analogous to those introduced in the hinge portions in the first two described embodiments of the invention, and hinge portion 212 will be biased from the intermediate or unstable position B toward the position C or toward the position A, depending on which side of the intermediate position B it happens to be on at a particular time.

Figure 17:
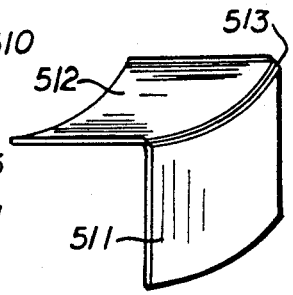
FIG. 17 is a side, isometric view of the hinge shown in FIG. 15, in molding position.
Figure 18:
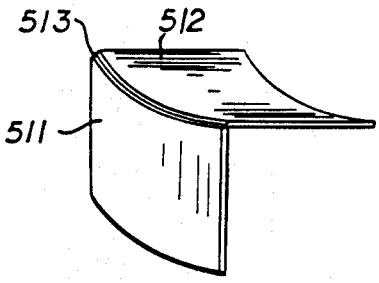
FIG. 18 is a side, isometric view of the hinge shown in FIG. 15 with one hinge portion swung 180° from the position shown in FIG. 17.

Reference is next made to the embodiment of the invention shown in FIGS. 15 through 18. These Figures show a hinge 510 made up of a first or reference hinge portion 511, a second or swingable hinge potion 512, and a reduced, integral connecting portion 513 therebetween. The reduced connecting portion connecting the edges of the two hinge portions 511 and 512 is molded so that the hinge is bowed into the arc of a circle having its radius parallel to portion 511. Thus, the reduced connecting portion is distorted so that it follows a path which is displaced from the straight line connecting its two ends. The hinge 510 is shown in FIG. 17 in a shape in which it has second hinge portion 512 in the form of a part of a cylinder having a radius perpendicular to its surface. When the hinge 510 is now swung into the position shown in FIGS. 15 and 16, as it swings through an intermediate or unstable position, which in this case is at an angle of about 45°, or between the 90° displaced positions in FIGS. 17 and 16, it is distorted, and then snaps into the stable position shown in FIG. 16. Furthermore, this hinge could be molded in the position shown in FIG. 17, but it would be far more preferable to mold it in the position shown in FIG. 16. In any event, when the hinge portion 512 is swung further, toward the position shown in FIG. 18, it now swings through a second intermediate or unstable position, in this case at an angle of about 135° or between the 90° displaced positions in FIGS. 16 and 18, in which case it is again distorted, and then snaps into the stable position shown in FIG. 18. This hinge shown in FIGS. 15 through 18 can thus be used in a variety of applications where a biased hinge is required, including as a lid for various closures and containers. However, while its principal may be employed in a wide variety of such applications, distinct differences in its mode of operation will arise in many such cases, particularly where the reference portion 511, for example, is affixed to stationary walls of containers, for example, and where the transfer of energy discussed above is not permitted to occur in that manner, or does not occur at all. In each such case, however, the basic structure and principals of operation of the hinge shown in FIGS. 15–18 are employed therein.

Figure 19:
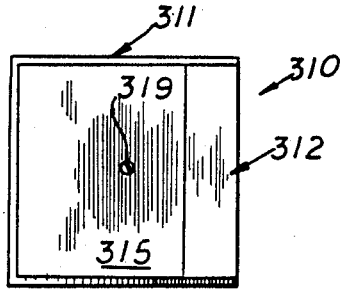
FIG. 19 is a top view of another embodiment of the hinge of the present invention in combination with a container.
Figure 20:
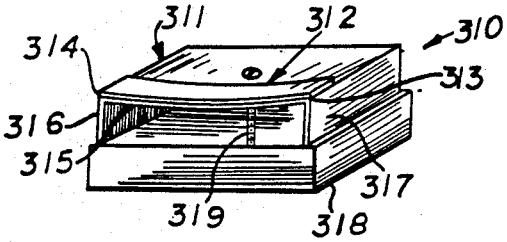
FIG. 20 is an isometric view of the hinge and container shown in FIG. 19, with the second hinge portion swung to a postion 180° from the position shown in FIG. 19.
Figure 21:
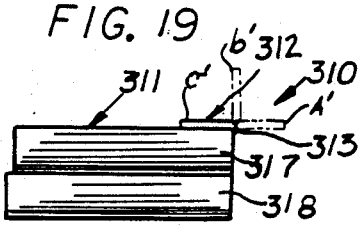
FIG. 21 is a side view of the hinge and container shown in FIG. 19, showing in phantom view the second hinge portion swung 90° and 180° from the position shown in FIG. 20.
Figure 22:
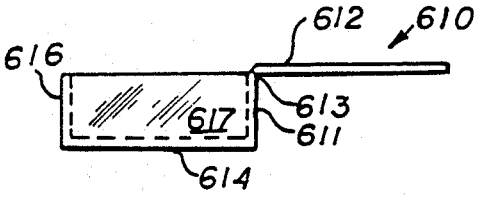
FIG. 22 is a side view of another embodiment of the hinge of the present invention in combination with a container.
Figure 23:
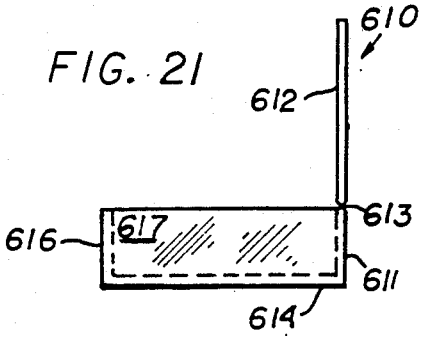
FIG. 23 is a side view of the hinge and container of FIG. 22, showing the cover in its intermediate position.

Reference is next made to the embodiment of the invention shown in FIGS. 19 through 21. These Figures show a hinge 310 along with a portion of a container including downwardly extending flanges 316 and 317 supported on a base 318. The plate-like hinge portions 311 and 312 may in this case be molded flat, and portion 311 can then be bowed downward toward the base 318 by means of a screw 319, thereby bowing the top surface of plate-like hinge portion 311 into substantially the shape of a part of a cylinder having a radius of curvature perpendicular to the hinge portion 311. It will be noted in FIG. 19 that the second hinge portion 312 is forced by portion 311 into a bow that is conformed to the surface of the hinge portion 311 when in the molding position.

When the hinge portion 312 then swings through the intermediate position b′ shown in FIG. 21 to the right hand position a′, in the intermediate position hinge portion 312 will be distorted to a warped shape again much like that of FIG. 4. As the portion 312 is swung toward the position of FIG. 20 (i.e. c′) the portion 312 will be curved in the opposite direction from the radius of the curve the hinge portion 312 has in position a′. Thus, when the hinge portion 312 swings from positions a′ to c′ shown in FIG. 19, the hinge portion 312 will be biased toward the position on either side of the intermediate position b′. That is, the hinge will be biased to swing open and to swing closed, depending on the side of the neutral position b′ that it is on at any particular time.

Figure 24:
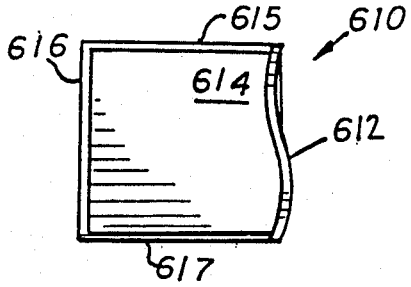
FIG. 24 is a top view of the hinge and container of FIG. 22.
Figure 25:
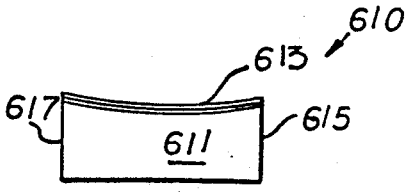
FIG. 25 is an end view of the hinge and container of FIG. 22, with the cover swung 180° from the position shown in FIG. 22.

Reference is next made to the embodiment of the invention shown in FIGS. 22–25. In this embodiment a combined hinge and container 610 utilizing same is shown, with the hinge including a first hinge portion 611, which in this case is molded with its upper end bowed about a radius of curvature parallel to the surface of the second hinge portion 612, which can thus be molded in the shape of a portion of a cylinder. The hinge line or reduced connecting portion is curved due to the curved top of hinge portion 611. The container shown in conjunction with this hinge has a bottom 614, a top 612 comprising a second hinge portion, which again is molded in the bowed shape of a partial cylinder in the molding position shown in FIG. 22, a flat front 616, and a back comprising the first hinge portion 611 having a curved top. The top edge of the hinge portion 611 is curved or bowed about a radius extending generally parallel to the plate-like hinge portion 611. The bowed top or hinge portion 612 has a straight edge attached to the curved top edge of the hinge portion 611, as is best shown in FIG. 25, which thus creates the reduced connecting portion 613, which thus swingably, integrally connects the first hinge portion or back 611 to second hinge portion or top 612. When the container is in the open position shown in FIG. 22, it is in molding position, and introduces no added stress into the portion 612. When the second hinge portion 612 is swung toward the position shown in FIG. 25, a stress will be introduced between the hinge members by the straight end of hinge portion 612 swinging on the curved end of portion 611. This stress will tend to bias top 612 toward the open position. When the second hinge portion 612 then reaches the intermediate position shown in FIGS. 23 and 24, the stresses introduced in the hinge portions distorts them as indicated in FIG. 24, which tends to bias the top 612 either toward the open position shown in FIG. 22 or the closed position shown in FIG. 25, depending on which side of the intermediate position shown in FIGS. 23 and 24 the member 612 is in at any particular time. Thus, the top will be biased to swing open or to swing closed. Once again, this bow can be molded in a two piece mold in the position shown in FIG. 22.

Figure 26:
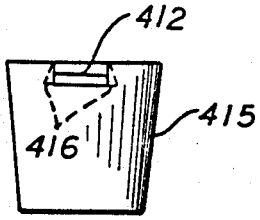
FIG. 26 is a front view of another embodiment of the hinge of the present invention, in combination with a closure.
Figure 27:
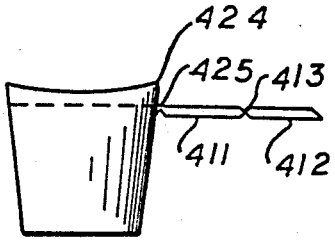
FIG. 27 is a side view of the hinge and closure shown in FIG. 25, with the lid member and closure shown in molding position.
Figure 28:
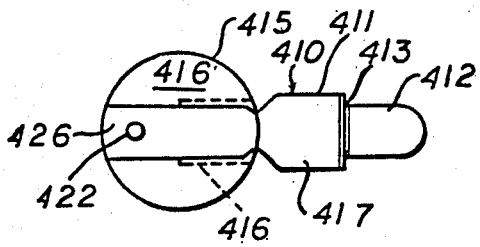
FIG. 28 is a top view of the hinge and closure shown in FIG. 27.
Figure 29:
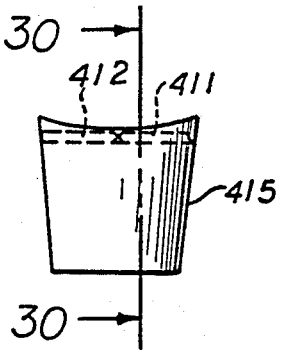
FIG. 29 is a side view of the hinge and closure shown in FIG. 22, with the lid in the closed position.
Figure 30:
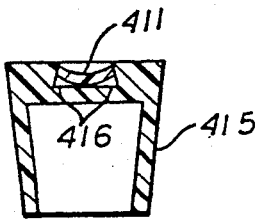
FIG. 30 is a cross-sectional view of the hinge and closure of FIG. 22, taken along line 30—30 of FIG. 29.

Reference is next made to the embodiment of the invention shown in FIGS. 26 through 30. In this case, the hinge is shown in conjunction with a closure 415, which could, for example, be a cap for a bottle internally threaded therefore. The cap has a generally cylindrical side wall, and a top 416 with a dispensing hole 422. The lid 410 is made up of a first hinge portion 411, a second hinge portion 412, and an integral reduced connecting hinge portion 413 therebetween. It will be noted that the top 416 includes slot 426 which is undercut, as best shown in FIG. 26, and the first hinge portion 411 is wider than the slot 426. The hinge portion 411 will thus be bowed downward in the shape of an inverted cylinder, as shown in FIG. 30, when contained in slot 426, and it will therefore transmit a force through the integral hinge portion 413, and thus a distortion is created in the second hinge portion 412. This distortion will be in the form of a bow having its radius of curvature perpendicular to the bottom of slot 426. The hinge portion 412 will thus be biased toward either the open or closed position, like the hinge in the embodiment of FIGS. 1 through 6. When the hinge portions are thus swung to the closed position shown in FIGS. 26 and 29, from the open molding position shown in FIGS. 27 and 28, the first hinge portion 411 will then be biased toward the closed position as shown in FIGS. 29 and 30. Then a distortion in the form of a curved hinge line 413 can be developed in the hinge members, which will bias the second hinge member 412 either to an open position or to a closed position. The closure and lid can be molded as one integral piece in a two piece mold in the position shown in FIGS. 27 and 28. The portions 411 and 412 will thus be molded flat, and member 411 will be bowed when closed and forced into slot 426, as shown in FIG. 30.

Figure 31:
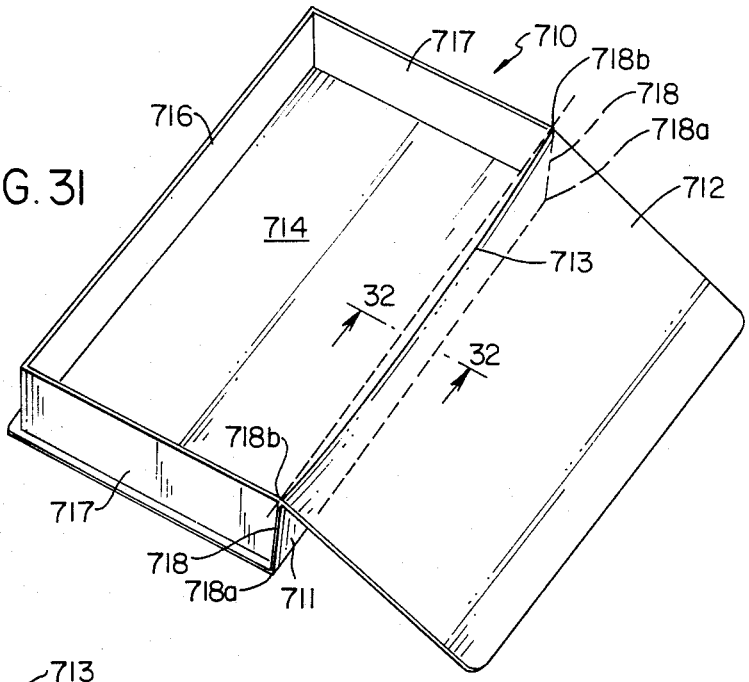
FIG. 31 is a top, isometric view of another embodiment of the hinge of the present invention in combination with a container.
Figure 32:
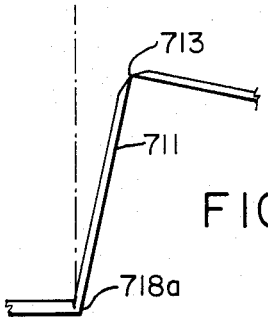
FIG. 32 is a side, cross-sectional view of the hinge of FIG. 31, taken along lines 32—32 thereof.
Figure 33:
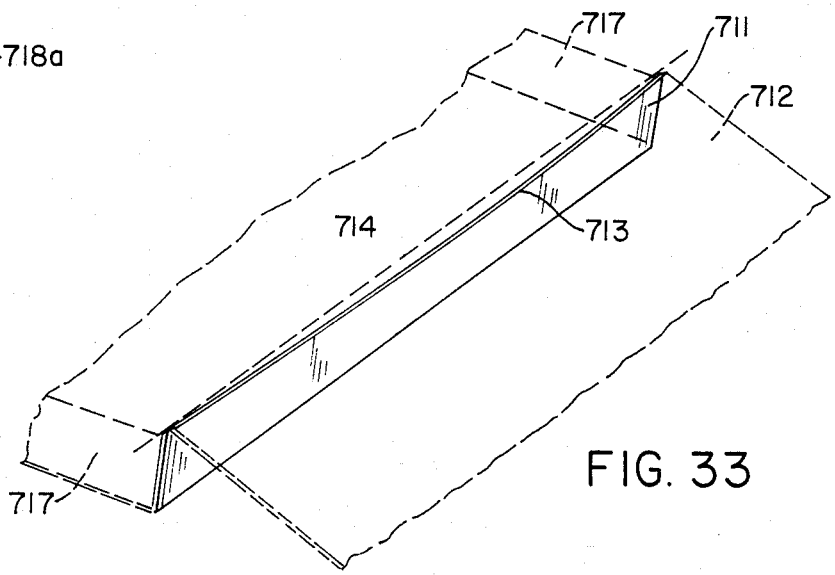
FIG. 33 is a partial, top, elevational view of a portion of the hinge and container of FIG. 31, shown with the lid open.
Figure 34:
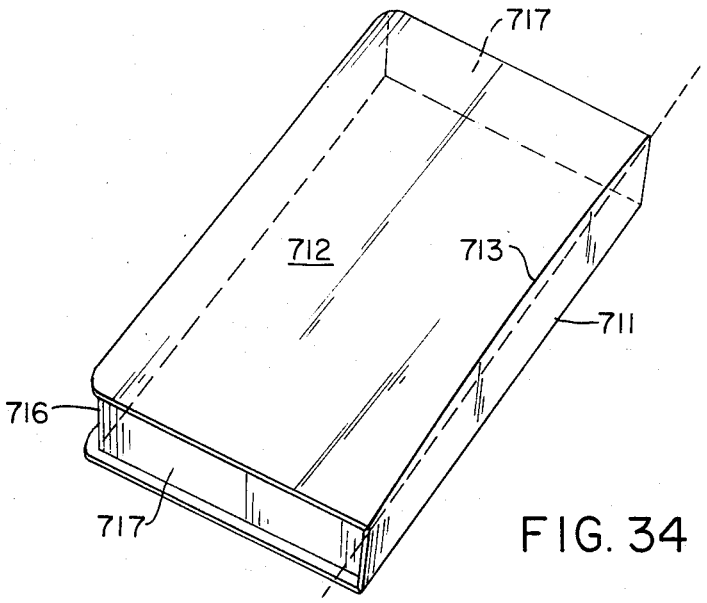
FIG. 34 is a top, elevational view of the hinge and closure of FIG. 31, with the lid in the closed position.

Referring next to the embodiment of the invention shown in FIGS. 31–34, in this embodiment a container 710 is shown, including a base 714 upstanding side walls 717 and upstanding front wall 716. The hinge of the present invention thus includes the first hinge portion 711, which comprises the back wall of the container 710, the second hinge portion 712, which comprises the cover of the container, and the integral, reduced connecting hinge portion 713 therebetween. In this embodiment, the distortion in the reduced connecting portion of the hinge 713 is created in a different manner. Thus, during the molding process the first hinge portion 711 is molded in a manner such that at the seams 718 between the side walls 717 and the first hinge portion 711 forming the back wall of the closure, at the lower terminus 718*a* thereof the actual seam between the ends of the first hinge portion 711, that is between points 718*a* on either end thereof, forms a substantially straight line connection. However, the first connecting portion 711 is molded in a distorted manner, so that at the upper end 718*b* of these seams 718, the integral, reduced connecting hinge portion 713 is bowed outwardly, and displaced from a straight line connecting points 718*b* from each other when the container is in the as-molded or open lid position shown in FIGS. 31 and 33. Thus, when viewing the cross-section of the first hinge portion 711, as shown in FIG. 32, from its lower to its upper end (representing the reduced connecting portion 713), that rear face is bowed outwardly, to varying degrees, between the seam ends 718*a* and 718*b*. In this manner, the second hinge portion 712 (representing the lid of the container), is urged into this open position, as shown in FIG. 31, and a force has to be exerted on this lid to close it. As the lid is moved towards the closed position by lifting the second hinge portion 712 and swingably rotating it about the reduced connecting portion 713, it approaches an intermediate position in which it is substantially parallel to the first hinge portion 711. In this distorted, unstable position it corresponds, for example, to the distortions shown in FIGS. 4 and 24 hereof. As the second hinge portion 712 is moved further towards the closed position, as shown in FIG. 34, the distortions in the first hinge portion are translated through the reduced connecting portion 713, which now flips over to the other side of the straight line connecting points 718*b*, into the configuration shown in FIG. 34. The second hinge portion or lid 712 is now urged into the closed position and force is required to open the lid or rotate it in a clockwise direction as shown in FIG. 34. Again, it is thus seen that on either side of this intermediate position the second hinge portion 712 is urged away from that position, alternately into the open position of FIG. 31 and the closed position of FIG. 34.

Figure 35:
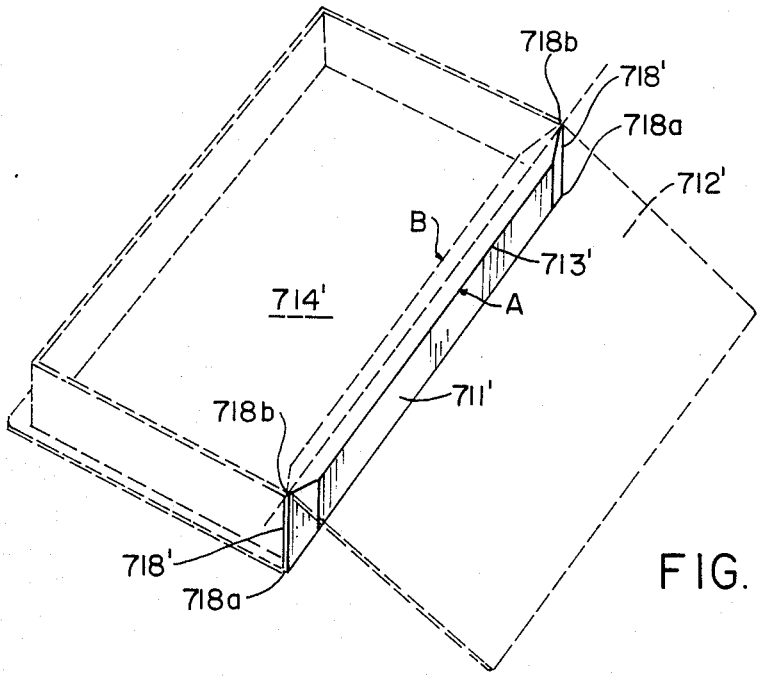
FIG. 35 is a partial, elevational view of another embodiment of the hinge of the present invention in combination with a container.

Referring next to the embodiment of the present invention shown in FIG. 35, this embodiment essentially corresponds to the embodiment discussed above and shown in FIGS. 31–34. The only difference in this case is that in the open position as shown in FIG. 35, instead of the first hinge portion 711′ in this case being distorted in a gradual manner in the shape of an arc between points 718*b*′, in this case the first hinge portion representing the back face of the container 711′ is molded so that between points 718*b*′ when the container is in the open position shown in FIG. 35, the reduced connecting hinge portion 713′ is distorted in a series of straight lines, creating the equivalent of the bowed effect shown in FIGS. 31 and 33. Nevertheless, the reduced connecting portion 713′ is still displaced from the straight line connecting points 718*b*′ from each other in the same general manner as was the case in the embodiment shown in FIGS. 31–34.

Figure 36:
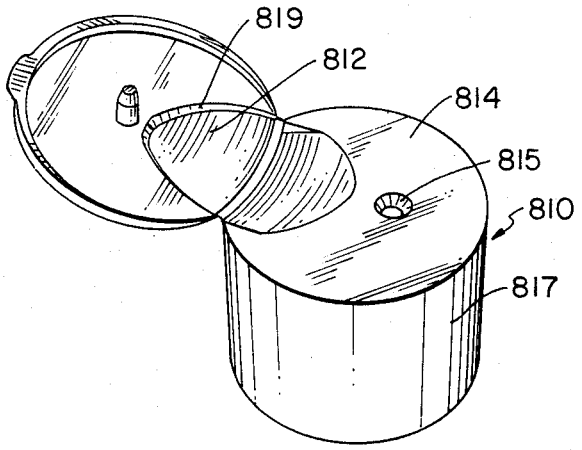
FIG. 36 is a front, isometric view of another embodiment of the hinge of the present invention in combination with a container.
Figure 37:
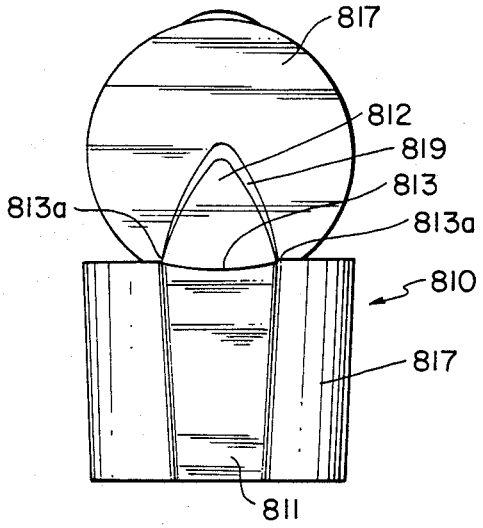
FIG. 37 is a side, elevational view of the hinge and container of FIG. 36.

Referring next to the embodiment of the present invention shown in FIGS. 36 and 37, a cap 810 is shown, including a substantially cylindrical side wall 817, and a top portion 814 including an aperture 815 thereon. A portion of the circular wall 817 comprises the first hinge portion 811, and has a substantially planar surface thus forming a chord with respect to the overall cylindrical shape of the wall 817. The second hinge portion 812 comprises a portion of the lid 817. Furthermore, the first and second hinge portions 811 and 812 are connected by an integral, reduced connecting hinge portion 813 therebetween. The two ends of the reduced connecting portion 813 are designated as points 813*a* in FIG. 37. In the molding operation the connection between these points is distorted so as to create a curved surface 813 therebetween, again displaced from the straight line connecting these two points. In comparison to the embodiments discussed above, it can thus again be seen that the swinging of cap 817 from the open position shown in FIG. 36 to the closed position, will create distortions in a similar manner to that discussed above in connection with other such embodiments. In this case, however, in view of the fact that the first hinge portion 811 forms a portion of the overall surface of circular wall 817, forces created in first hinge portion 11 will be transmitted elsewhere, i.e. it will be rather difficult to distort the first hinge portion 811. These forces will thus be transmitted through the reduced connecting portion 813 into the second hinge portion 812. Therefore, in this case the second hinge portion 812 comprises only a portion of the overall lid 817, and is segregated therefrom by a further reduced integral portion 819, which is shown as having a basically parabolic shape in FIGS. 36 and 37. In this manner, distortions in the second hinge portion 812 are segregated from the remaining portion of the cap 817, and are basically retained within the second hinge portion 812. Indeed, in the embodiment shown in FIGS. 36 and 37 the thickness of the overall second hinge portion 812 is reduced as compared to the thickness of the remaining portion of cap 817, again to accept these distortions created by the swinging movement of the cap portion 817 around the reduced connecting portion 813. Therefore, once again the cap 817 is urged to an open and closed position on either side of its intermediate position in which the first and second hinge portions 811 and 812 are basically parallel or in a common plane with respect to each other.

Figure 38:
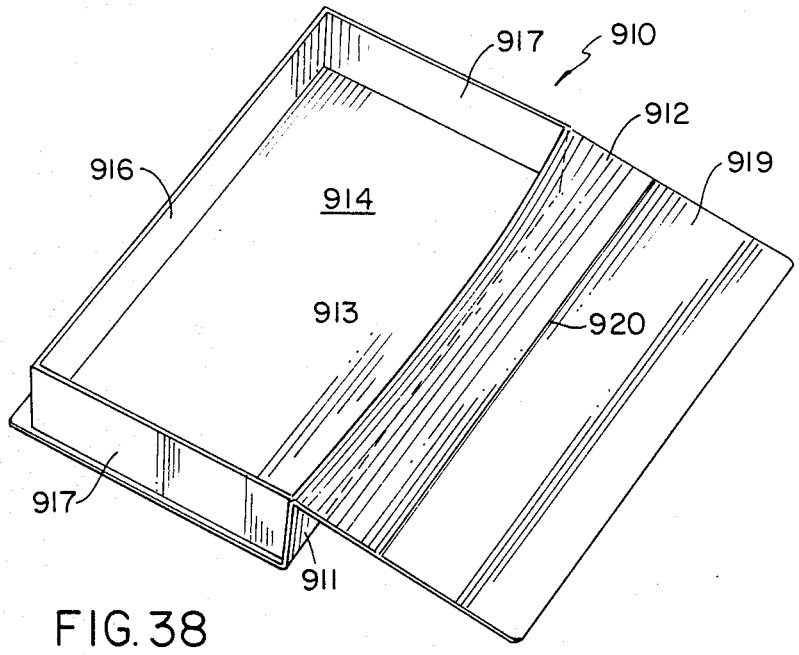
FIG. 38 is a top, elevational view of another embodiment of the hinge of the present invention in combination with a container.
Figure 39:
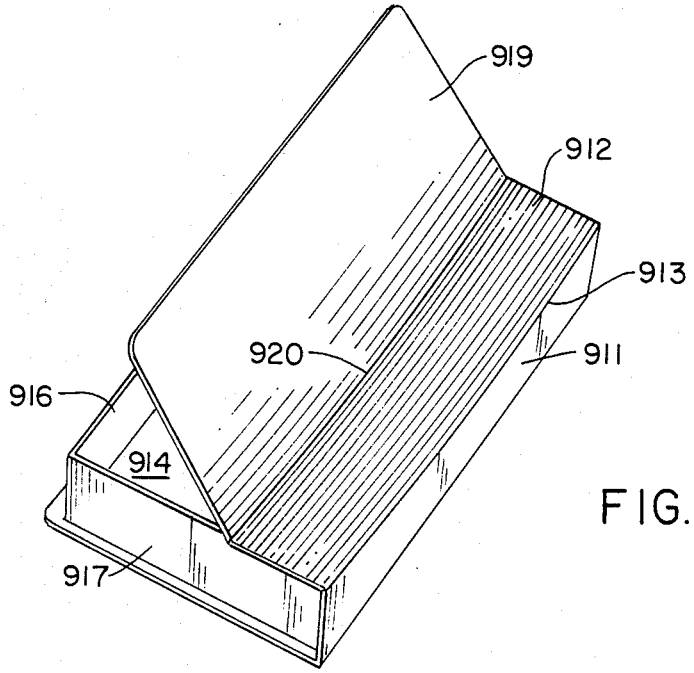
FIG. 39 is a top, elevational view of the hinge and container of FIG. 38, with the lid partially closed.

Referring to the embodiment of the present invention shown in FIGS. 38 and 39, the principle of the present invention is applied to a container as shown therein. The container 910 shown in FIGS. 38 and 39 includes a base 914, upstanding side walls 917, and upstanding front wall 916. In this case the first hinge portion 911 again basically comprises the rear wall of the container 910, but in this case the second hinge portion 912 comprises only a portion of the overall lid 919 thereof. The first and second hinge portions 911 and 912 are again integral with a reduced connecting portion 913, which is bowed so as to be displaced from a straight line connecting the end points thereof. In this manner, the relationship between the first and second hinge portions 911 and 912 is the same as that of the first and second hinge portions 711 and 712 for the container shown in FIG. 31, for example. However, in this case, in actual use the hinge represented by portions 911 and 912 need not ever operate in order to employ the present invention. Its mere existence, however, effects the operation of the remaining portion of lid 919 which is connected to the second hinge portion 912 by reduced connecting portion 920. That is, when the second hinge portion 912 is in the closed position as shown in FIG. 39, since it must follow the curvature of the reduced connecting portion 913, it will be concave downwardly, with its central portion lower than its ends. Because this second hinge portion 912 is integral with the remaining portion 919 of the cover through interconnecting hinge portion 920, a corresponding concave curvature is created in portion 919. However, the degree of such curvature will be dissipated as one extends outwardly from reduced connecting portion 913, so that at the outer ends of portion 919, there will be very little such concavity produced. The concave shape created in portion 919 by the hinge of this invention thus creates a downward force which tends to close portion 919, again as shown in FIG. 39. These forces are transmitted to portion 919 irrespective of the degree to which it is opened with respect to hinge 920 and the base portion of container 910. Furthermore, even if the second hinge portion 912 is permanently sealed in the closed position, as shown in FIG. 39, and thus never swings about reduced connecting portion 913, it nevertheless is considered to comprise the "swingable" hinge portion of this invention, since its configuration creates the necessary forces in portion 919 and interconnecting hinge 920 to take advantage of these forces in the finished product in question. Also, in the fully opened position as shown in FIG. 38, in which this container 910 could be molded, the second hinge portion 912 is again concave downwardly as shown therein, again creating a similar curvature in portion 919.

Figure 40:
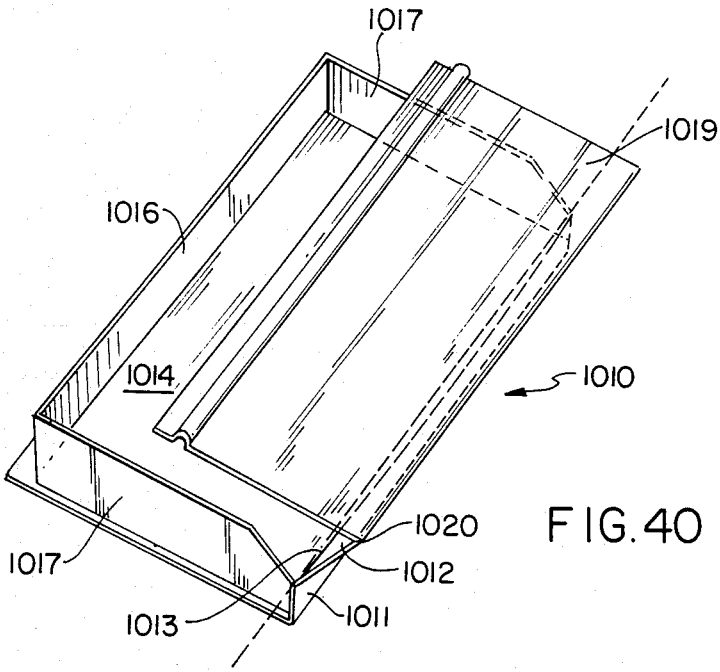
FIG. 40 is a top, elevational view of another embodiment of the hinge of the present invention in combination with a closure, with the lid open.
Figure 41:
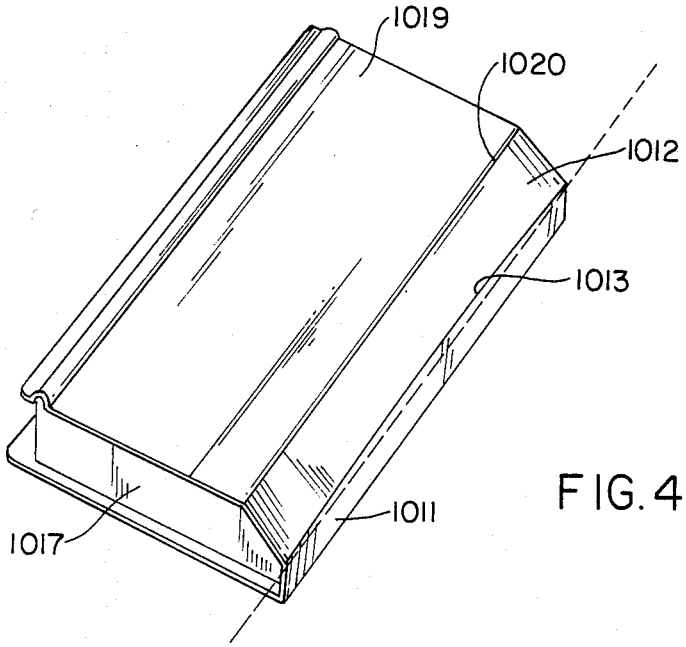
FIG. 41 is a top, elevational view of the hinge and closure of FIG. 40, with the lid closed.

Reference is next made to the embodiment of the present invention shown in FIGS. 40 and 41. In this embodiment, a container 1010 is shown, including a base 1014, a pair of upstanding side walls 1017, and an upstanding front wall 1016. A first hinge portion 1011, comprising the rear wall of the container, is again provided much like the construction shown in FIG. 31. However, the first hinge portion 1011 in this case extends upwardly only a portion of the overall height of the upstanding side walls 1016 and 1017 of the remaining portion of the container. The second hinge portion 1012 is then connected to the first hinge portion 1011 through the integral, reduced connecting portion 1013, which is again bowed so as to follow a path displaced from a straight line connecting the ends thereof. To this extent the relationship between the first and second hinge portions 1011 and 1012 is the same as that as discussed above in connection with FIG. 31. Also in this case, the second hinge portion 1012 comprises only a portion of the lid for closure 1010. The remaining portion of the lid 1019 is hingedly attached to the end of second hinge portion 1012 by reduced connecting hinge portion 1020. Thus, the remaining upper portion of the lid 1019 comprises a substantial portion of the entire lid. However, the snap action created between first and second hinge portions 1011 and 1012 in this case causes the remaining portion of the lid 1019 to extend in an open position as shown in FIG. 40 and to completely cover the container in the manner shown in FIG. 41.

Figure 43:
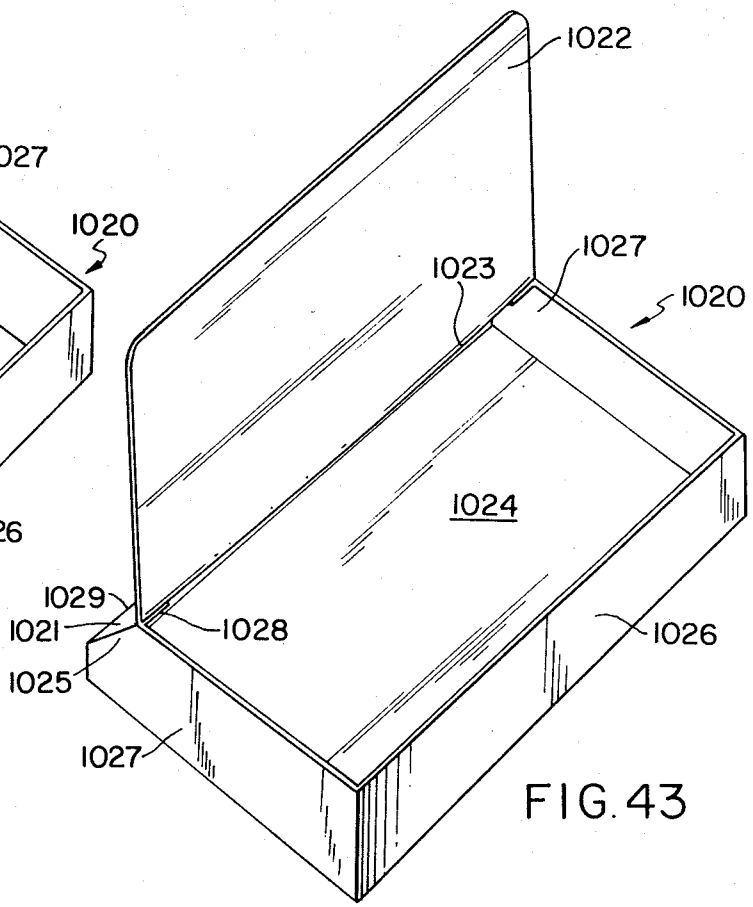
FIG. 43 is a top, isometric view of the hinge and closure shown in FIG. 42, with the lid partially closed.
Figure 42:
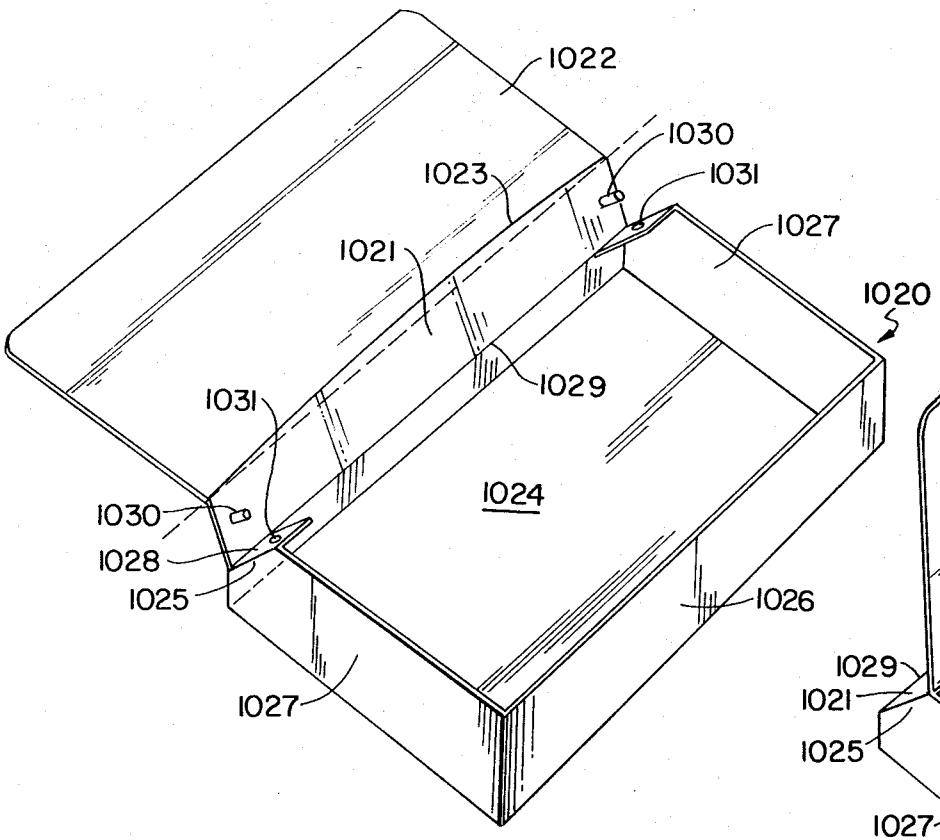
FIG. 42 is a top, isometric view of another embodiment of the hinge of the present invention in combination with a container.

Referring next to the embodiment of the present invention shown in FIGS. 42 and 43, a container 1020 is shown therein. This container again includes a base 1024, upstanding side walls 1027 and an upstanding front wall 1026. This container 1020 also includes a rear wall 1025 of a conventional design, which, however, is not the full height of the front wall 1026. The rear and side walls 1025 and 1027, respectively, are thus connected by a short sloping portion 1028 which thus forms a portion of the upper surface of the side wall 1027. The first hinge portion 1021 is thus itself connected to the rear wall 1025 by means of an integral hinge 1029, which is of a conventional nature. Furthermore, the first hinge portion 1021 can include two upstanding pin members 1030, while the sloping portions 1028 can include two corresponding apertures 1031, so that when the first hinge portion 1021 is rotated about hinge 1029 the pins 1030 can enter apertures 1031 to closably secure same. Second hinge portion 1022 comprises the remaining portion of the lid of the container 1020, and the first and second hinge portions 1021 and 1022 are again integral with a reduced connecting hinge portion 1023 therebetween. Reduced connecting hinge portion 1023 again has the bowed configuration discussed above, so that its path is displaced from the straight line connecting the ends thereof, again as shown in FIG. 42. Thus, the snap action of the present invention is translated to the second hinge portion 1022. In this manner, as is shown in FIG. 43, when the first hinge portion 1021 is in a closed position as shown in FIG. 43, with the pins 1030 in the apertures 1031, etc., the second hinge portion 1022 can either be in an open position in which it is substantially vertical, or it can swing around the bowed hinge portion 1023 to be in a fully closed position in abutment with the front and side walls 1026 and 1027 respectively.

It will be understood that the embodiments described herein are merely exemplary and that a person skilled in the art may make many variations and modifications without departing from the spirit and scope of the invention. All such modifications and variations are intended to be included within the scope of the invention as defined in the appended claims.

What I claim is:

1. A container comprising a container body and a lid therefor, said container body including depending wall means extending from said lid and defining an inner container space including an access opening into said inner container space, whereby said lid provides closure means for said access opening into said container space, said lid including a unitary hinge including a substantially planar swingable portion having a first thickness, a substantially planar reference portion having a second thickness, and a substantially linear connecting portion having a reduced thickness substantially less than said first and second thicknesses, said substantially planar swingable portion and said substantially planar reference portion merging continuously into said substantially linear connecting portion whereby when said substantially planar swingable portion and said substantially planar reference portion are aligned in a substantially common plane, said hinge comprises a substantially smooth and uninterrupted surface, said substantially linear connecting portion being integral with said substantially planar swingable portion and said substantially planar reference portion and extending continuously between a first point and a second point in a manner such that said substantially linear connection portion follows a path which is displaced from a straight line connecting said first and second points and which lies in a plane substantially perpendicular to the plane of said substantially planar reference portion of said hinge, whereby upon swinging said substantially planar swingable portion about said connecting portion said substantially planar swingable portion swings through an intermediate position such that on one side of said intermediate position said substantially planar swingable portion is urged into a first bowed configuration and on the other side of said intermediate position said substantially planar swingable portion is urged into a second bowed configuration, said first and second bowed configurations comprising configurations bowed on opposite sides of the plane of said substantially planar swingable portion into open and closed positions corresponding to said first and second bowed configurations are derived from oppositely directed stresses created within said substantially planar swingable portion on opposite sides of said intermediate position.

2. The container of claim 1, wherein said substantially planar reference portion of said lid includes a first end corresponding to said connecting portion and a second end displaced from said connecting portion, and wherein said substantially planar reference portion comprises a plurality of paths between said first and second ends having a degree of curvature which is substantially continuously reduced as compared to that of said path of said connection portion.

3. The container of claim 1, comprising molded plastic.

4. The container of claim 1 wherein said lid includes a reference hinge member attached to said substantially planar reference portion whereby said substantially planar reference portion may be caused to swing about said reference hinge member between first and second reference portion positions.

5. The container of claim 4, wherein said reference hinge member is integral with said substantially planar reference portion.

6. The container of claim 1, wherein said path comprises a plurality of substantially linear path portions.

7. The container of claim 1 wherein said lid includes a reduced portion having a predetermined shape abutting said connecting portion and being integral with said substantially planar swingable portion, said reduced portion having a reduced thickness as compared to said first thickness of said substantially planar swingable portion.

8. The container of claim 7, wherein said predetermined shape of said reduced portion is substantially arcuate.

9. The container of claim 7, wherein said predetermined shape of said reduced portions is substantially parabolic.

10. A container comprising a container body and a lid therefor, said lid including a substantially planar lid portion having a first thickness, said container body including a base portion and side wall means extending from said base portion, a predetermined portion of said side wall means comprising a substantially planar reference portion for said substantially planar lid portion, said substantially planar reference portion having a second thickness and being connected to said substantially planar lid portion by a substantially linear connecting portion having a reduced thickness substantially less than said first and second thicknesses and providing a hinge therefor, said substantially planar reference portion and said substantially planar lid portion merging continuously into said connecting portion whereby when said substantially planar reference portion and said substantially planar lid portion are aligned in a substantially common plane, said hinge comprises a substantially smooth and uninterrupted surface, said substantially planar reference portion including a first end connected to said base portion and a second end corresponding to said connecting portion, said substantially planar lid portion being swingable about said connecting portion between a closed position in which said lid is in contact with said side wall and an open position, and said connecting portion being molded into a configuration such that it follows a path which is displaced from a straight line connecting the ends of said connecting portion, whereby said substantially planar lid portion is swingable from said closed position to said open position through an intermediate position such that on either side of said intermediate position said substantially planar lid portion is urged away from said intermediate position towards said open and closed positions, respectively, whereby the forces urging said substantially planar lid portion into said open and closed positions are derived from oppositely directed stresses created within said substantially planar lid portion.

11. The container of claim 10, wherein said reference portion comprises a plurality of paths between said first and second ends having a degree of curvature which is substantially continuously reduced a compared to that of said path of said connecting portion.

12. The container of claim 10 comprising molded plastic.

13. The container of claim 12 wherein said plastic comprises a thermoplastic material.

14. The container of claim 12 wherein said plastic comprises a thermosetting material.

15. The container of claim 10 wherein said connecting portion follows a path comprising a plurality of substantially linear path portions.

16. A container comprising a container body and a lid therefor, said lid including a substantially planar reference portion having a first thickness, a substantially planar swingable portion having a second thickness and a substantially linear connecting portion having a reduced thickness less than said first and second thicknesses, said substantially planar reference portion and said substantially planar swingable portion merging continuously into said connecting portion whereby when said substantially planar swingable portion and said substantially planar reference portion are lying in a substantially common plane, said substantially planar reference portion including a first end and a second end, said first end of said substantially planar reference portion being connected to said said container body and said second end of said substantially planar reference portion corresponding to said connecting portion, said substantially planar swingable portion including a first end and a second end, said first end of said substantially planar swingable portion corresponding to said connecting portion and said second end of said substantially planar swingable portion being adapted to swing between a closed position in contact with said container body and an open position, said connecting portion being integral with both said substantially planar reference portion and said substantially planar swingable portion and extending continuously between a first point and a second point on opposite sides of said lid in a manner such that said connecting portion follows a path which is displaced from a straight line connecting said first and second points so that the portion of said connecting portion intermediate of said first and second points is displaced from said second end of said substantially planar swingable portion as compared to said first and second ends of said connecting portion.

17. The container of claim 16 wherein said container body includes a base and a plurality of side wall members extending therefrom, and wherein said substantially planar reference portion of said lid is hingedly attached to one of said plurality of side wall portions of said container body.

18. The container of claim 16 wherein said container body and said lid comprise unitary molded plastic body.

19. The container of claim 16 wherein said lid includes a reduced connecting portion integral with said swingable portion and said remaining portion of said lid.

20. The container of claim 19 wherein said substantially planar swingable portion is thinner than said remaining portion of said lid.

21. The container of claim 19 wherein said connecting portion is substantially arcuate.

22. The container of claim 20 wherein said connecting portion is substantially parabolic.

* * * * *